US006352413B1

(12) United States Patent
Popov

(10) Patent No.: US 6,352,413 B1
(45) Date of Patent: Mar. 5, 2002

(54) MULTI-STAGE JET PUMP ARRANGEMENT FOR A VACUUM APPARATUS

(75) Inventor: Serguei A. Popov, 4615 Post Oak Pl., Suite 140, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/402,019

(22) PCT Filed: Jan. 26, 1999

(86) PCT No.: PCT/IB99/00134

§ 371 Date: Sep. 27, 1999

§ 102(e) Date: Sep. 27, 1999

(87) PCT Pub. No.: WO99/37927

PCT Pub. Date: Jul. 29, 1999

(30) Foreign Application Priority Data

Jan. 27, 1999 (RU) ..... 98101488

(51) Int. Cl.[7] ..... F04B 23/04
(52) U.S. Cl. ..... 417/77; 417/151
(58) Field of Search ..... 417/77, 244, 313, 417/151

(56) References Cited

U.S. PATENT DOCUMENTS 4,451,184 A * 5/1984 Mitchell ..... 406/105
5,363,664 A * 11/1994 Beakley et al. ..... 417/77
5,986,133 A * 11/1999 Holtzapple et al. ..... 562/608

FOREIGN PATENT DOCUMENTS

| | | |
|---|---|---|
| DE | 1050498 | 8/1959 |
| DE | 1092044 | 11/1960 |
| RU | 2084707 | 7/1997 |
| SU | 559098 | 7/1977 |
| SU | 866298 | 9/1981 |
| SU | 1588925 | 8/1990 |

OTHER PUBLICATIONS

Sokolov E.Y., "Jet apparatuses" book, 1970, USSR, Moscow, "Energy" Publishing house, p. 215.

* cited by examiner

*Primary Examiner*—Cheryl J. Tyler
(74) *Attorney, Agent, or Firm*—Mark A. Oathout

(57) ABSTRACT

A pumping-ejection system has a vacuum separator, a pump connected through its suction port to the vacuum separator, an inlet liquid-gas ejector, a discharge liquid-gas ejector and an outlet separator. The outlet separator is furnished with a pipe for liquid tapping, which connects the outlet separator to the vacuum separator. The liquid inlet of the discharge ejector is connected to the discharge side of the pump. The introduced pumping-ejection system requires lower power inputs for its operation.

3 Claims, 1 Drawing Sheet

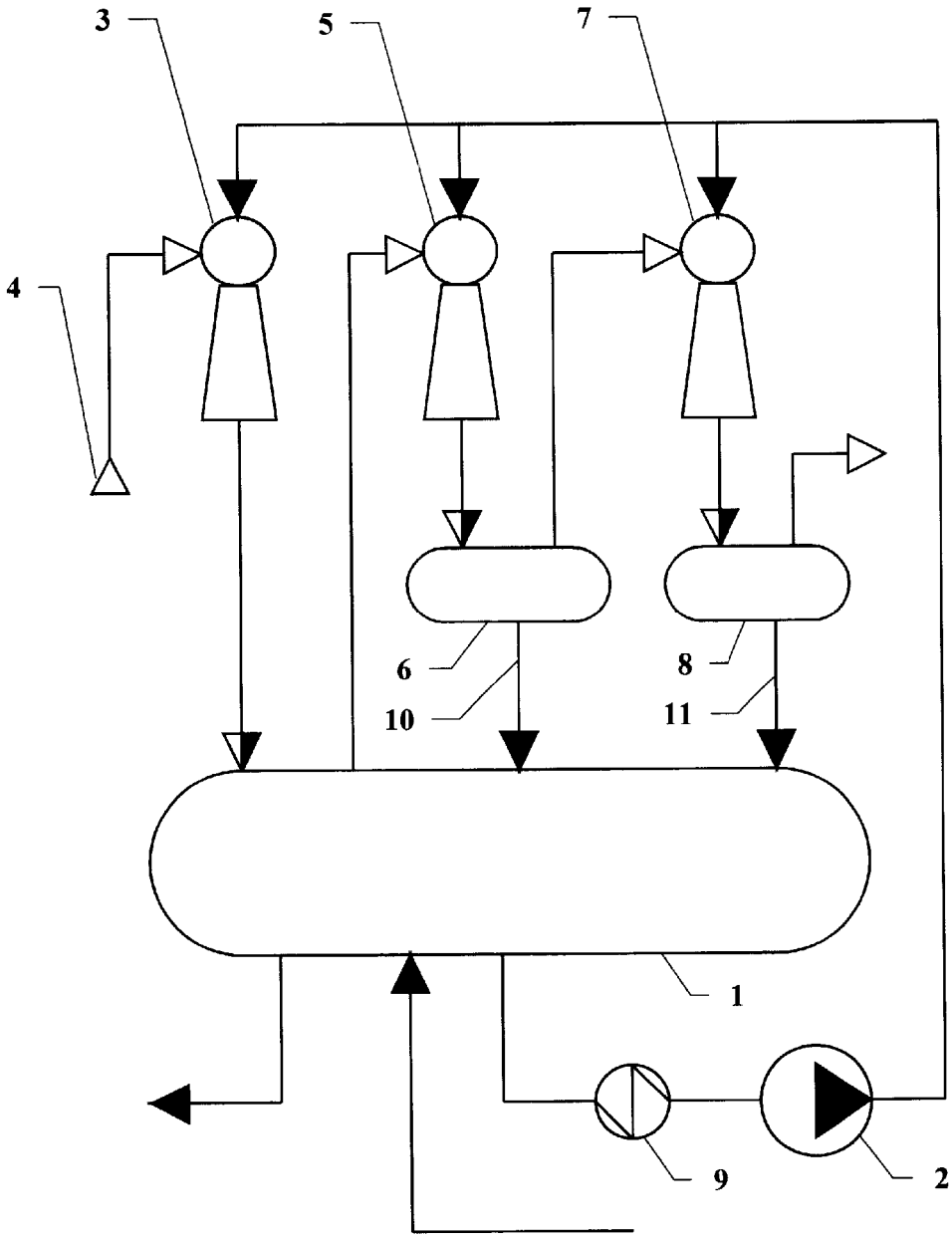
3
5
7
4
6
10
8
11
1
9
2

MULTI-STAGE JET PUMP ARRANGEMENT FOR A VACUUM APPARATUS

This application claims priority of international application PCT/IB99/00134 filed Jan. 26, 1999 with priority of RU 98101488 filed Jan. 27, 1998.

BACKGROUND

The invention pertains to the field of jet technology, primarily to pumping-ejection systems for producing a vacuum.

A pumping-ejection system is known, which has a liquid-gas ejector and a pump. The gas inlet of the ejector is connected to a source of an evacuated gaseous medium, the liquid inlet—of the ejector is connected to the discharge side of the pump, an outlet of the ejector is connected to a drainage system (see "Jet Apparatuses", book of E. Y. Sokolov, N. M. Zinger, "Energia" Publishing house, Moscow, 1970, page 215).

The main imperfection of this system is its low efficiency.

The closest analogue of the system introduced in the present invention is a pumping-ejection system having a vacuum separator, a pump, an inlet liquid-gas ejector, a discharge liquid-gas ejector and an outlet separator, wherein the suction side of the pump is connected to the liquid outlet of the vacuum separator, the gas inlet of the inlet ejector is connected to a source of an evacuated gaseous medium, the liquid inlet of the inlet ejector is connected to the discharge side of the pump, an outlet of the inlet ejector is connected to the vacuum separator, the gas inlet of the discharge ejector is connected to the gas outlet of the vacuum separator, an outlet of the discharge ejector is connected to the outlet separator (see RU, patent, 2084707, cl. F 04 F 5/54, 1997).

This pumping-ejection system is intended for producing and maintaining a vacuum, mainly in rectification columns. More intensive operation of the system is achieved because the system incorporates two self-contained stages of evacuation. However, this arrangement with the two self-contained stages of evacuation has some shortcomings: the operational pressure within the second stage is higher than the operational pressure within the first stage, therefore a liquid medium circulating in the second-stage circulation loop is saturated with a solute gas more intensively if compared with a liquid medium circulating in the first-stage circulation loop. Continuous employment of a motive liquid saturated with a gas reduces the efficiency of the second-stage ejector and results in an increase in the energy consumption for providing the required flow rate of gases evacuated from the vacuum separator. Additionally, two independent loops of the motive liquid circulation require two independent pumps for delivery of the motive liquid to the ejectors inlets. This makes transfer of the motive liquid from one circulation loop to another more complex.

SUMMARY OF THE INVENTION

The present invention is aimed at attaining more economical operation of the system due to employment of a motive liquid with minimal content of a solute gas in all of the system's evacuation stages.

This objective is achieved as follows: a pumping-ejection system, which has a vacuum separator; a pump connected through its suction port to the vacuum separator; an inlet liquid-gas ejector, whose gas inlet is connected to a source of an evacuated gaseous medium, liquid inlet—is connected to the discharge side of the pump and whose outlet is connected to the vacuum separator; an outlet separator, a discharge liquid-gas ejector, whose gas inlet is connected to the vacuum separator and whose outlet is connected to the outlet separator; is furnished further with a pipe for liquid tapping, which connects the outlet separator with the vacuum separator, and the liquid inlet of the discharge ejector is connected to the discharge side of the pump. The pumping-ejection system can be furnished with an outlet liquid-gas ejector and with a final separator. In this case the gas inlet of the outlet ejector is connected to the outlet separator, the liquid inlet of the outlet ejector is connected to the discharge side of the pump, an outlet of the outlet ejector is connected to the final separator, and the liquid outlet of the final separator is connected to the vacuum separator. In addition, the system can be furnished with a heat exchanger-cooler installed at the suction side of the pump.

It was determined, that the condition of a motive liquid being fed by the pump into the nozzles of the liquid-gas ejectors through their liquid inlets, exerts a significant influence on the performance the of the pumping-ejection system as a whole. The main factor which affects the condition of the motive liquid most of all is the content of a solute gas in the motive liquid.

As it was noted above, in the prototype pumping-ejection system a motive liquid is fed from the outlet separator into the second-stage liquid-gas ejector under a pressure, which is higher than a pressure maintained in the vacuum separator, and this is the cause of a lower capacity of the second-stage ejector. This effect is explained by the fact that the motive liquid always contains a certain quantity of a solute gas and emission of the solute gas from the motive liquid occurs when pressure in the ejector receiving chamber becomes equal to the saturation pressure of the solute gas. Therefore the ejector gas capacity decreases, because, together with an evacuated gaseous medium, the ejector must evacuate the gas evolved from the motive liquid.

In the pumping-ejection system described in the present invention, a motive liquid is fed into the nozzles of all ejectors from the vacuum separator, because prior to feeding the motive liquid into the nozzles of appropriate ejectors, the motive liquid from the separators of the consequent stages is transferred into the vacuum separator, where the lowest pressure is maintained and where the liquid is degassed most effectively. Thus, the motive liquid degassed under a lowest possible pressure is fed into the nozzles of all ejectors. As compared with the prototype system, the pumping-ejection system of the introduced layout ensures a higher gas capacity or less energy consumption in view of equal gas capacity.

Thus, a more economical operation is provided by the described system.

BRIEF DESCRIPTION OF THE DRAWING

A schematic diagram of the described pumping-ejection system is presented in the drawing.

DETAILED DESCRIPTION

The pumping-ejection system has a vacuum separator 1, a pump 2 whose suction side is connected to the vacuum separator 1, an inlet liquid-gas ejector 3 whose gas inlet is connected to a source 4 of an evacuated gaseous or gas-vapor medium, liquid inlet is connected to the discharge side of the pump 2 and outlet is connected to the vacuum separator 1, and a discharge liquid-gas ejector 5 whose gas inlet is connected to the vacuum separator 1 and outlet is connected to an outlet separator 6. The outlet separator 6 is furnished with a pipe 10 for liquid bleeding, which connects it to the vacuum separator 1. The liquid inlet of the discharge ejector 5 is connected to the discharge side of the pump 2.

In addition, the system can be furnished with a third stage of evacuation including an outlet liquid-gas ejector 7 and a final separator 8. In this case the gas inlet of the outlet ejector 7 is connected to the outlet separator 6, the liquid inlet of the outlet ejector 7 is connected to the discharge side of the pump 2, an outlet of the outlet ejector 7 is connected to the final separator 8, the liquid outlet of the final separator 8 is connected by a pipe 11 to the vacuum separator 1. The system can be furnished also with a heat exchanger-cooler 9 installed between the vacuum separator 1 and the suction side of the pump 2.

The pumping-ejection system operates as follows.

The pump 2 delivers a motive liquid, for example water or a hydrocarbon liquid, into the nozzles of the liquid-gas ejectors 3, 5 through their liquid inlets. The motive liquid flowing out of the nozzle of the inlet ejector 3 evacuates a gaseous or gas-vapor medium from the source 4 (the latter can be a rectification column, for example). The motive liquid mixes with the evacuated gaseous medium in the inlet ejector 3. Under certain conditions, for example when the evacuated medium contains some easy-condensable components, partial or complete condensation of the condensable components in the motive liquid can take place. At the same time the evacuated gaseous medium undergoes compression in the ejector 3 due to energy transfer from the motive liquid. A gas-liquid mixture flows from the inlet ejector 3 into the vacuum separator 1, where the motive liquid is separated from the evacuated gas. As a rule, condensation of the easy-condensable components of the evacuated gas in the motive liquid is completed in the vacuum separator 1. The gas separated from the motive liquid in the vacuum separator 1 is evacuated by the discharge ejector 5. So, a required vacuum is maintained in the vacuum separator 1. The motive liquid flowing out of the nozzle of the discharge ejector 5 evacuates the gas from the vacuum separator 1 and compresses it at the same time. A gas-liquid mixture formed in the discharge ejector 5 flows into the outlet separator 6, where the compressed gas is separated from the motive liquid. Then the compressed gas is delivered to consumers or is further utilized as discussed below. The motive liquid from the outlet separator 6 passes through the pipe 10 into the vacuum separator 1, where it is degassed prior to feeding into the nozzles of the ejectors 3, 5. Because pressure in the outlet separator 6 is higher than pressure in the vacuum separator 1, the motive liquid can flow from the outlet separator 6 to the vacuum separator 1 by gravity, though in some cases a pump (not shown) can be used for the motive liquid transfer from the outlet separator 6 to the vacuum separator 1.

When a high-pressure gas is required for consumers, the system can be additionally furnished with a third stage of evacuation including the outlet liquid-gas ejector 7 and the final separator 8. Generally, the number of the system stages can exceed three, if necessary. In this case additional stages are connected in series in the same way as described for the third stage. So, if it is necessary, the outlet ejector 7 evacuates the compressed gas from the outlet separator 6. The motive liquid flowing out of the nozzle of the outlet ejector 7 additionally compresses the evacuated compressed gas. A gas-liquid mixture from the outlet ejector 7 flows into the final separator 8, where the motive liquid is separated from the additionally compressed gas. The additionally compressed gas from the final separator 8 is delivered to consumers, the motive liquid from the final separator 8 is delivered to the vacuum separator 1 through a pipe 11 for degassing of the motive liquid. Then the liquid is fed by the pump 2 into the ejectors 3, 5, and 7. Because the motive liquid can be warmed during operation of the pumping-ejection system, the system can be equipped with the heat exchanger-cooler 9 for cooling the motive liquid.

Subject to specific operational conditions an additional quantity of the motive liquid can be fed into the vacuum separator 1, or a surplus liquid (for example, in case of accumulation of a large amount of condensate) can be removed from the vacuum separator 1.

Industrial Applicability: This invention can be applied in chemical, petrochemical, agriculture and some other industries.

What is claimed is:

1. A pumping-ejection system comprising:

a vacuum separator;

a pump;

an inlet liquid-gas ejector;

a discharge liquid-gas ejector; and an outlet separator;

wherein the outlet separator has a pipe for liquid tapping which connects the outlet separator to the vacuum separator, a suction side of the pump is connected to the vacuum separator, a gas inlet of the inlet liquid-gas ejector is connected to a source of an evacuated gaseous medium, a liquid inlet of the inlet liquid-gas ejector is connected to a discharge side of the pump, an outlet of the inlet liquid-gas ejector is connected to the vacuum separator, a gas inlet of the discharge liquid-gas ejector is connected to the vacuum separator, a liquid inlet of the discharge liquid-gas ejector is connected to the discharge side of the pump, and an outlet of the discharge liquid-gas ejector is connected to the outlet separator.

2. The pumping-ejection system according to claim 1, further including:

an outlet liquid-gas ejector; and a final separator;

wherein a gas inlet of the outlet liquid-gas ejector is connected to the outlet separator, a liquid inlet of the outlet liquid-gas ejector is connected to the discharge side of the pump, an outlet of the outlet liquid-gas ejector is connected to the final separator, and the final separator has a pipe which connects the final separator to the vacuum separator.

3. The pumping-ejection system according to claim 1, further including a heat exchanger-cooler installed at the suction side of the pump.

* * * * *